United States Patent [19]

Spence

[11] 4,402,397

[45] Sep. 6, 1983

[54] DISPLAY CASE WITH CASTELLATED TONGUE AND GROOVE JOINTS

[76] Inventor: Jack T. Spence, 2040 N. Shore Dr., Wayzata, Minn. 55391

[21] Appl. No.: 211,103

[22] Filed: Nov. 28, 1980

[51] Int. Cl.[3] ..... B65D 65/16

[52] U.S. Cl. ..... 206/45.34; 220/4 F; 220/67; 220/75; 220/355; 217/65

[58] Field of Search ..... 206/45.34; 217/12 R, 217/65; 220/4 F, 75, 76, 306, 355, 67, 72, 74

[56] References Cited

U.S. PATENT DOCUMENTS

| | | | |
|---|---|---|---|
| 1,467,675 | 9/1923 | Killion | 220/75 |
| 2,918,190 | 12/1959 | Martin | 220/4 F |
| 3,586,205 | 6/1971 | Van Daalen | 220/67 |
| 3,987,829 | 10/1976 | Leone | 220/355 X |

*Primary Examiner*—Steven M. Pollard

*Attorney, Agent, or Firm*—Williamson, Bains, Moore & Hansen

[57] ABSTRACT

A plastic display case which may be assembled from essentially flat components is provided with a castellated tongue and groove construction. This particular construction allows extremely high stacking strength to be provided from a relatively thin gauge material.

6 Claims, 4 Drawing Figures

DISPLAY CASE WITH CASTELLATED TONGUE AND GROOVE JOINTS

BACKGROUND OF THE INVENTION

Various display cases have been used in retail sales over the years, but heretofore such display cases have generally been made of glass and metal or wood. Such displays are generally not suitable for many uses due to their cost, weight, and fragility. In particular, the trend toward discount retail outlets having less formal displays has led to the problem of consumers opening boxes in order to see what the contents actually look like. Typically, displays in these outlets consist merely of a stack of boxes containing the goods in question (such as toys) and no real display case. Thus, it would be highly advantageous to have a display case which would be relatively inexpensive and allow the display of the goods and which could be placed upon a stack of the goods without excessively weighting those goods. Further, the relatively inexpensive nature of such a desired display case would allow greater variety and flexibility of display by the retailer.

SUMMARY OF THE INVENTION

The instant display case is molded from sheets of clear, vinyl plastic. The construction to be discussed hereinafter allows the plastic to be used in a much thinner gauge than would otherwise be possible if such construction were not utilized. The instant construction provides very strong joints at the various edges of the display case and thereby by providing such strong edges allows the device to have a very high stacking strength relative to what one might normally expect with a relatively thin gauge plastic.

The bottom of the device has a channel-like groove about its rectangular periphery. The top panel is identical to and interchangeable with the bottom panel. The front and rear panels have a castellated tongue member about all four sides thereof and each end member has two sides with the castellated tongue and two sides with the channel-like groove therein. The castellated tongue member has two sets of surfaces, each set being co-planar within that set, and the respective sets of surfaces being spaced from one another by connecting surfaces. Each set of surfaces in the tongue engages one of the sidewalls of the channel member. This construction allows tremendous strength in stacking.

These and other objects and advantages of the invention will become readily apparent as the following description is read in conjunction with the accompanying drawings wherein like reference numerals are used to refer to the views.

DESCRIPTION OF THE PREFERRED EMBODIMENT

Figure 1:
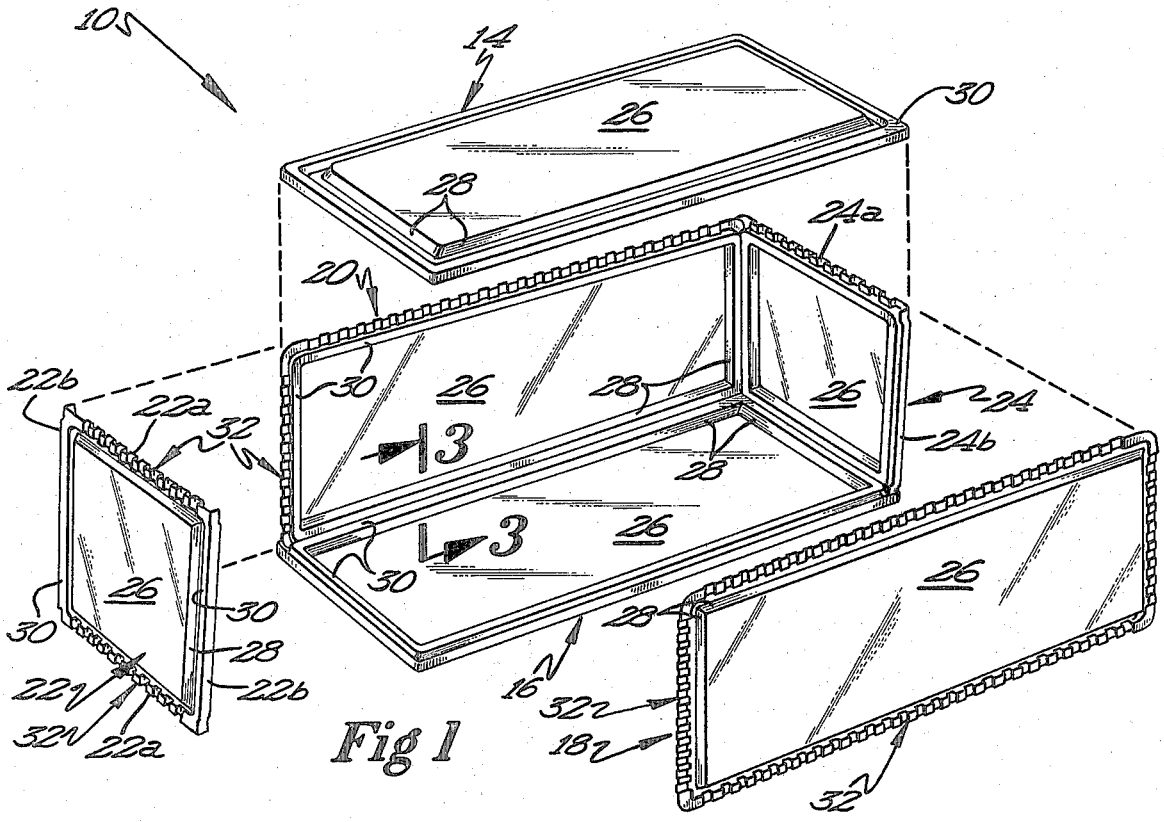
FIG. 1 is an exploded perspective view of the invention.
Figure 2:
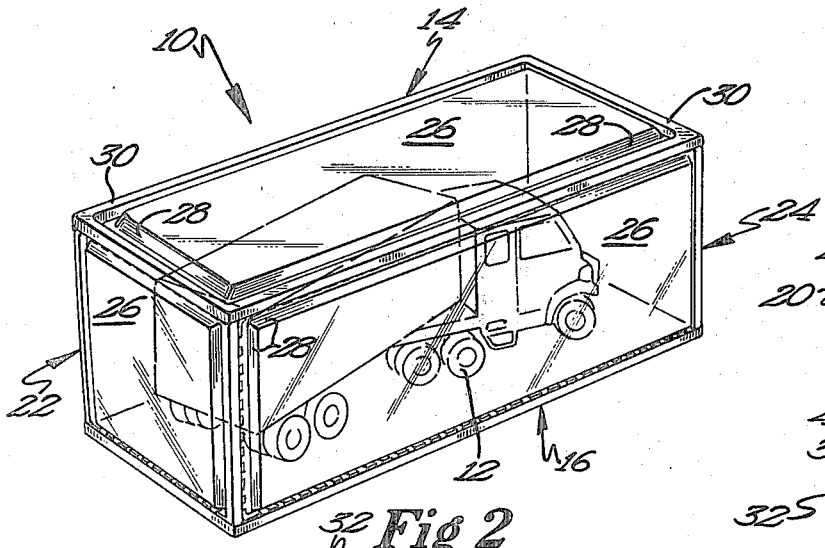
FIG. 2 is a perspective view of the instant invention.

The display case of the instant invention, generally 10, is illustrated in perspective in FIG. 2 and shows the case containing a toy 12 or other item to be displayed which would normally be packaged in a box and hence not visible to the consumer except by opening the box. FIG. 1 shows display case 10 being comprised of a top panel 14, a bottom panel 16, first and second side panels, 18 and 20 respectively, and first and second end panels 22 and 24. Each of those panels consists of a main viewing panel 26, four angled framing panels 28 and a rectangular indented surrounding panel 30.

Figure 3:
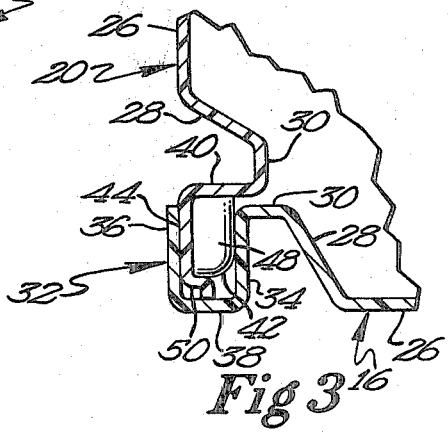
FIG. 3 is a section taken along lines 3—3 of FIG. 1
Figure 4:
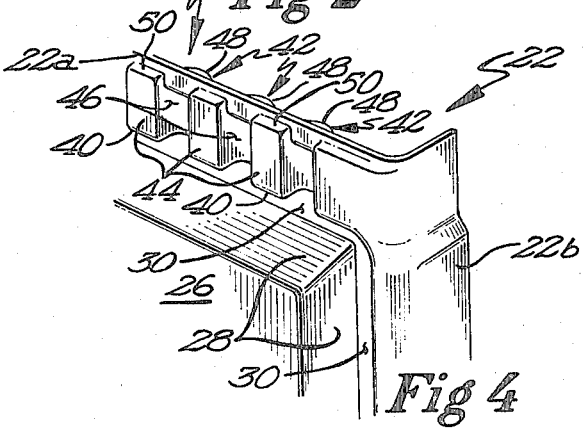
FIG. 4 is a detailed enlargement of a portion of FIG. 1.

FIGS. 3 and 4 show in more particularity the tongue and groove construction so effective in the instant invention. In particular, grooves 32 adjoin framing panels 30 on those sides where a groove 32 will be utilized. Each groove 32 is comprised of an inner wall 34 depending downwardly from panel 30, a bottom wall 38 depending at right angles from inner panel 34, and an outer wall 36 depending from bottom panel 38. Inner panel 34 presents a first wall for engagement with tongue 42 as will be more fully described hereinafter while outer wall 36 presents a second wall for engagement with tongue 42.

Each tongue 42 depends outwardly from a tongue support panel 40 which is in turn attached to frame surrounding panel 30. Each tongue 42 is comprised of a plurality of first wall engaging surfaces 46 and a set of second wall engaging surfaces 44. Each set of surfaces is coplanar and sets 44 and 46 are parallel to each other but spaced apart a distance approximately equal to the distance between first and second walls 34 and 36 respectively. The first and second wall engaging surfaces 44 and 46 are joined in a castellated fashion by connecting surfaces 48 which lie at right angles to surface sets 44 and 46. If desired, end surfaces 50 may cover part or all of the portion of tongue 42 which adjoins the bottom wall 38 of groove 32.

As mentioned previously, each part of the instant invention may be molded from a single piece of plastic, preferably a vinyl. Of course, other suitable materials may be used if desired. Because of the high strength offered by the inventive joint construction in the instant invention, a much thinner gauge plastic may be used than would otherwise be required with more conventional joint construction. In particular, in the preferred embodiment, the display case 10 is constructed of 0.030 inch vinyl as opposed to the 0.060 inch material that would be required with a more conventional joint. The strength produced by the invention thus allows the material cost of the product to be cut in half. It is to be noted that the instant invention may be produced from three molds, namely, a mold at the top (bottom), side and end. This construction serves to reduce tooling costs substantially.

The instant invention may also be applied to a round container; i.e., one having a cylindrical shape which is formed of a tube of plastic or a sheet of plastic joined together to form a tube and having the tongue member of the instant invention at either end thereof. Symmetrical top and bottom members have circumferential grooves thereon for engagement with the tongues at either end of the cylindrical piece.

While the preferred embodiment of the present invention have been described, it should be understood that various changes, adaptations and modifications may be made therein without departing from the spirit of the invention and the scope of the appended claims.

What is claimed is:

1. A knockdown display case constructed of a thin, molded plastic sheet material, said display case comprising:

a top panel;

a bottom panel;

two side panels; and two end panels, said panels being joined to one another by friction-fit tongue and groove joints, each said panel having a substantially planar central section extending adjacent to and offset from said joints, and wherein each said groove has substantially planar first and second walls, said first and second walls being connected by a bottom wall, the tongue in each of said joints comprising:

a plurality of first wall engaging surfaces;

a plurality of second wall engaging surfaces, said first wall engaging surfaces being spaced from and co-planar with one another and said second wall engaging surfaces being spaced from and coplanar with one another, wherein a first plane defined by said first surfaces and a second plane defined by said second surfaces are spaced from and parallel to one another; and a plurality of connecting surfaces, said connecting surfaces being substantially parallel to one another and normal to said first and second planes.

2. The display case of claim 1 wherein each connecting surface connects one of said first wall engaging surfaces to one of said second wall engaging surfaces.

3. The display case of claim 2 wherein said bottom and top panels are rectangular and said bottom and top panels have grooves along each side thereof.

4. The display case of claim 3 wherein each of said side panels is rectangular and has a said tongue along each side thereof.

5. The display case of claim 4 wherein each of said end panels comprises first and second edges having tongues thereon for engagement with said top and said bottom respectively.

6. The display case of claim 5 wherein each of said end panels further comprises third and fourth edges having said grooves therein for engagement with said side panels.

* * * * *